US009142932B2

(12) United States Patent
Liaw et al.

(10) Patent No.: US 9,142,932 B2
(45) Date of Patent: Sep. 22, 2015

(54) SOCKET CONNECTOR WITH CONTACT TERMINAL HAVING OXIDATION-RETARDING PREPARATION ADJACENT TO SOLDER PORTION PERFECTING SOLDER JOINT

(75) Inventors: Been-Yang Liaw, New Taipei (TW); Chih-Pi Cheng, New Taipei (TW); Fu-Jin Peng, Shenzhen (CN); Zhan-Jun Xu, Shenzhen (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 444 days.

(21) Appl. No.: 13/444,866

(22) Filed: Apr. 12, 2012

(65) Prior Publication Data

US 2012/0202384 A1 Aug. 9, 2012

Related U.S. Application Data

(63) Continuation-in-part of application No. 13/033,334, filed on Feb. 23, 2011.

(30) Foreign Application Priority Data

Oct. 23, 2010 (CN) ..... 2010 1 0517511
Aug. 19, 2011 (CN) ..... 2011 1 0239665

(51) Int. Cl.

| | |
|---|---|
| ***H01R 12/00*** | (2006.01) |
| ***H01R 43/16*** | (2006.01) |
| ***H01R 12/57*** | (2011.01) |
| *H01R 13/03* | (2006.01) |

(52) U.S. Cl.

CPC ..... *H01R 43/16* (2013.01); *H01R 12/57* (2013.01); *H01R 13/03* (2013.01); *Y10T 29/49213* (2015.01)

(58) Field of Classification Search

CPC ..... H01R 12/57
USPC ..... 439/83, 876
See application file for complete search history.

(56) References Cited

U.S. PATENT DOCUMENTS 3,915,546 A * 10/1975 Cobaugh et al. ..... 439/876
4,120,558 A 10/1978 Seidler (Continued)

FOREIGN PATENT DOCUMENTS

CN 2618319 Y 5/2004
CN 2718822 Y 8/2005

(Continued)

*Primary Examiner* — Neil Abrams
(74) *Attorney, Agent, or Firm* — Wei Te Chung; Ming Chieh Chang

(57) ABSTRACT

An electrical connector having a fusible element for mounting on a substrate includes an insulative housing and a contact terminal retained in the insulative housing. The contact terminal includes a resilient contacting arm extending beyond a mating face of the insulative housing and a soldering portion for mating with the fusible element. A gelatinous flux is deployed on the fusible element, and/or on the soldering portion, and/or between the fusible element and the soldering portion, and then flux is dried to immovably fix the fusible element with respect to the soldering portion. The dried flux will be re-juvenile to clean and remove an oxidized layer originally existed on the soldering portion so as to achieve robust welding quality. Besides, a method for trimming an electrical connector to have robust welding properties is also disclosed.

13 Claims, 14 Drawing Sheets

(56) References Cited

U.S. PATENT DOCUMENTS

| | | | | |
|---|---|---|---|---|
| 4,575,167 | A | 3/1986 | Minter | |
| 4,678,250 | A | 7/1987 | Romine et al. | |
| 4,722,470 | A | 2/1988 | Johary | |
| 4,846,734 | A | 7/1989 | Lytle | |
| 5,145,722 | A * | 9/1992 | Kaspaul | 427/388.1 |
| 5,453,017 | A | 9/1995 | Belopolsky | |
| 5,984,694 | A * | 11/1999 | Sinclair | 439/70 |
| 6,024,584 | A | 2/2000 | Lemke et al. | |
| 6,042,389 | A | 3/2000 | Lemke et al. | |
| 6,116,921 | A * | 9/2000 | Scholz et al. | |
| 6,155,845 | A * | 12/2000 | Lin et al. | 439/83 |
| 6,175,150 | B1 | 1/2001 | Ichikawa et al. | |
| 6,181,544 | B1 | 1/2001 | Nakagawa et al. | |
| 6,325,644 | B1 * | 12/2001 | Lemke et al. | 439/83 |
| 6,550,667 | B2 * | 4/2003 | Bernier et al. | 228/207 |
| 6,572,397 | B2 | 6/2003 | Ju | |
| 6,641,410 | B2 | 11/2003 | Marvin et al. | |
| 6,676,440 | B1 * | 1/2004 | Inamine et al. | 439/500 |
| 6,969,286 | B1 | 11/2005 | Mongold et al. | |
| 7,029,292 | B2 * | 4/2006 | Grabbe | 439/83 |
| 7,140,886 | B1 * | 11/2006 | Chen | 439/83 |
| 7,147,489 | B1 * | 12/2006 | Lin | 439/83 |
| 7,278,864 | B2 * | 10/2007 | Tsai | 439/83 |
| 7,484,971 | B2 * | 2/2009 | Gailus et al. | 439/83 |
| 7,534,113 | B2 * | 5/2009 | Liao et al. | 439/83 |
| 7,682,165 | B2 * | 3/2010 | Liao | 439/83 |
| 8,033,839 | B2 * | 10/2011 | Yeh et al. | 439/83 |
| 8,052,434 | B2 * | 11/2011 | Yeh et al. | 439/83 |
| 2007/0293060 | A1 | 12/2007 | Ju | |
| 2012/0100758 | A1 * | 4/2012 | Liaw et al. | 439/660 |

FOREIGN PATENT DOCUMENTS

| | | | |
|---|---|---|---|
| CN | 2842814 | Y | 11/2006 |
| CN | 200986990 | Y | 12/2007 |
| GB | 2392778 | * | 3/2004 |
| JP | 10-172620 | * | 6/1998 |
| TW | M318206 | | 9/2007 |

* cited by examiner

SOCKET CONNECTOR WITH CONTACT TERMINAL HAVING OXIDATION-RETARDING PREPARATION ADJACENT TO SOLDER PORTION PERFECTING SOLDER JOINT

CROSS REFERENCE

This application is a continuation-in-part of U.S. patent application Ser. No. 13/033,334, filed Feb. 23, 2011, now, which is related to patent application Ser. No. 12/763,226, filed Apr. 20, 2010, now U.S. Pat. No. 8,052,434, which is a continuation of U.S. patent application Ser. No. 12/853,317, filed Aug. 10, 2010, now U.S. Pat. No. 8,033,839. The content of each of the above-referenced U.S. patents and patent applications is incorporated by reference herein in its entirety.

BACKGROUND OF THE INVENTION

1. Field of the Invention

The present invention relates to a socket connector, and more particularly to a socket connector incorporated with a contact terminal having a layer of solder affinity and oxidation retarding preparation adjacent to a tail portion of the contact terminal as well as a solder ball attached thereto so as to achieve perfect solder joint.

2. Description of the Related Art

Soldering between a solder tail of a contact terminal and a conductive pad on a printed circuit board is comparably reliable and commonly practiced in the electrical connector field. When conducting a soldering process, there is a dilemma. On one hand, it is requested that the solder tail expresses solderable property, i.e. the solder can be readily and easily attached thereto. If the solder joint is not properly formed between the solder tail and the printed circuit board, defective interconnection or so called cold-joint will be encounter. Rework process will always be needed to correct this problem. On the other hand, because of this solderable property, the solder tends to flow upward or wick along an external surface of the solder tail. Once the solder flows and wicks upwardly along the surface resulted from the capillary force, the overall characteristic of the contact terminal will be changed or negatively modified if the wicking reaches up to a middle portion of a contact terminal. For example, when the contact terminal is designed, intended normal force, deflection, etc. have been carefully calculated so as to meet the field requirements. Once the solder flows and wicks upwardly to cover the contact terminal, the characteristic of the contact terminal will be altered, and the normal force and other properties will be altered accordingly. In worse situation, a connector after soldering will be found failed resulted from this solder wicking. As a result, the contact terminal is requested to provide a mechanism to limit the wicking.

U.S. Pat. No. 4,019,803 (hereinafter US'803) issued to Schnell on Apr. 26, 1977 discloses a solder substrate clip having a contact arm. A mass of solder is secured to the arm on a side away from a contact surface and a solder globule integral with the mass of solder at an edge of the arm extending from the mass across the edge of the arm to the contact surface for engagement with a contact pad on the substrate.

U.S. Pat. No. 4,846,734 issued to Lytle on Jul. 11, 1989 discloses a connector featuring that a connector adapted to be attached to a mother printed circuit board and to removably receive a daughter printed circuit board of the edge card type and adapted to mechanically and electrically couple the mother and daughter printed circuit boards. According to its disclosure, the invention may be incorporated into a method to make the contact terminal and which further includes the step of fabricating the contact of phosphor bronze. The method further includes the step of plating the contact with nickel to a thickness of about between 0.000050 and 0.000150 inches. The method further includes the step of plating the lower portion of the contact with solder of about 60 percent tin and 40 percent lead to a thickness of about between 0.000100 and 0.000500 inches. The method further includes the step of plating the contact portion of the contact with about 40 microinches thick or thicker of PdNi flashed with gold to a thickness of about 0.000004 inches nominally. It is known to the skilled in the art that tin-lead is solderable material, while nickel oxide is non-solderable. Because of that, a tin-lead coating is applied to the lower portion, which according to Lytle, it increases solderablility of the lower portion which is intended to be soldered into a via of a printed circuit board.

U.S. Pat. No. 5,453,017 issued to Belopolsky on Sep. 26, 1995 expressivebly take the advantage of the benefit disclosed in Lytle. In Belopolsky, it discloses an improved connector for an electronic module or the like and includes a housing having a socket opening that is sized and configured to accept an electronic module, and a plurality of terminals mounted to the housing. Each of the terminals has a foot portion having a layer of non-solderable material coated on one side of the foot portion to prevent solder from adhering to that side. An arched capillary nest is formed by a channel surface on the underside of the foot portion when the terminal is mounted on a conductor pad such that solder flows through the capillary nest under the influence of capillary forces from the side of the terminal having a non-solderable coating thereon to the other side for forming a solder joint on that other side. A ring of non-solderable material is coated around a middle portion of the terminal to prevent solder from flowing to the electrical contact surfaces located above the ring. As a result, the connector terminals can be soldered to a printed circuit board or the like in a simple and inexpensive manner and without the formation of known solder defects. As disclosed by Belopolsky, solderable material used in capillary nest is to promote solderability on the solder tail, while the non-solderable ring located at the middle portion limits the solder from wicking further upward. However, it is very difficult to fabricate the capillary nest especially when the dimension of the terminal becomes smaller and smaller.

U.S. Pat. No. 4,722,470 issued to Johary on Feb. 2, 1988 discloses another mechanism to overcome or control the solder wicking. According to Johary, a solder transfer member for applying discrete bodies of solder of predetermined size to the leads of a component for subsequent surface mounting to a substrate. The transfer member is a plate having a non-wetted surface, for example titanium, with an array of cavities matching the component lead pattern, each having a volume corresponding to the desired amount of solder to be applied to the corresponding lead. The method includes placing solder paste on the transfer member and filling the cavities by wiping the plate surface. The component is placed on the transfer member with the leads contacting the solder paste in the cavities. Reflow of the solder paste bonds to each lead a discrete body of solder having a precisely determined size. To limit wicking of solder on the leads, selective masking may be performed by applying a water soluble mask coating to the leads and removing the mask from selected areas by placing the component against a surface charged with water before placing the component on the transfer member.

U.S. Pat. No. 6,042,389 issued to Lemke on Mar. 28, 2000 disclosed another mechanism to limit the solder wicking issue. According to FIG. 6, along with description, "The opening 96 also can function as a thermal break to retard solder wicking, in the same manner as openings 89 in the FIG. 6 embodiment. The terminal 90 may also include passivation or anti-wicking coatings to prevent solder flow toward the contact sections. Aperture or opening 89 defined in the contact tail 76 is used to limit the wicking issue."

In addition, in the above described Schnell '803 patent, the specification makes another disclosure. According to its description, along with FIGS. 1 to 4, it looks like that Schnell uses energy to control the wicking issue. According to Schnell, the amount of energy supplied to the interface between the solder mass and the arm is sufficient to melt the entire mass, in that way assuring that a relatively large mass of molten solder does not coat the contact surface of the arm. While molten solder does not readily flow across the raw uncoated edges, a relatively large amount of molten solder could flow across the edges and coat the contact surface. This is undesirable because when a substrate is moved into the mouth the arms are bent further apart than intended due to the thickness of the solder coating and may be overstressed. During soldering of the clip to the substrate, the thick layer of solder would be melted freeing the arms for undesired movement during the soldering operation. Overstressed arms may not be strong enough to engage the substrate tightly.

U.S. Pat. No. 4,120,558 issued to Seidler on Oct. 17, 1978 discloses another way, as compared to Lemke and Schnell, to attach the solder mass to the contact. Seidler uses spring fingers to mechanically hold the solder mass, such as shown in FIGS. 1 to 5, and 13 to 15. According to Seidler, each clip includes a flat body portion 15, a pair of spring fingers 16, bent to extend upwardly and laterally from the plane of the body portion distally of the clip and spaced apart by the width of a central spring finger 17 which extends laterally in a position spaced from and substantially parallel to the fingers 16, defining a gap 21 adapted to receive the edge of a substrate (not shown). The fingers 16 and 17 are formed from the blank shown in FIG. 4 by the parallel cuts 18 which terminate at end points 18'. An additional gripping finger 19 is provided by the U-shaped cut 20, the sides of which lie parallel to the cuts 18 and the closed end 20' being below the line of the ends 18', this finger thus being formed partially from the material in the central finger 17. The free end of the finger 17 is curved arcuately away from the finger 16, and the gripping finger 19 is curved arcuately toward the curved end of finger 17, in a position to grip securely the short cylindrical slug of solder 22, as clearly shown in FIGS. 1, 2 and 3.

U.S. Pat. No. 6,969,286 issued to Mongold on Nov. 29, 2005 discloses another type of mechanism to attach the solder mass to the solder tail. According to Mongold, an electrical connector includes a connector body, a plurality of cores and a plurality of electrically conductive contacts disposed in the cores of the connector body. Each of the contacts includes a fusible member attached thereto. Each of the fusible members includes an intermediate portion and two support members disposed on opposite sides of the intermediate portion. The support members are arranged to hang down below a tail portion of the contacts. As illustrated in FIG. 1B, it looks like the solder mass 40a, 40b is attached to the contact terminal 22 in a manner of a landing gear of an airplane. According to Mongold, each fusible member 40 has two support portions 40a, 40b which are connected to each other by an intermediate portion 40c. The two support portions 40a, 40b are disposed opposite to each other and spaced from each other by a distance that is equal to a length of the intermediate portion 40c. The two support portions 40a, 40b may preferably have substantially flattened bottom surfaces as shown in FIG. 1B. However, the bottom surfaces of the support portions 40a, 40b may also have other shapes such as rounded, spherical, conical, square, rectangular, and other suitable shapes.

China Utility Model Patent No. CN2618319Y published on May 26, 2004 discloses an arrangement in which both the contact and housing is used to hold the solder mass thereto. This arrangement is similar to what illustrated by Seidler, and Schnell, while the housing of the connector body is also used.

U.S. Pat. No. 6,572,397 issued to Ju on Jun. 3, 2003 discloses another arrangement in which the solder mass is held by a cuverlinear portion of a solder tail.

US Pat. Pub. No. 20070293060 submitted by Ju discloses another arrangement in which a cradle-shaped portion is used to hold the solder mass.

China Utility Model Patent No. CN2718822Y published on Aug. 17, 2005 discloses an arrangement in which two contact terminals are arranged within a single passageway and a solder ball is held by two solder tails of the contact terminals.

On the other hand, the use of gold on electrical contacts, specially on the solder portion is also well established in the electronic industry. Gold's high reliability under repeated use, its resistance to corrosion, and low contact resistance, makes it an outstanding material for coating electrical contacts, especially those used in low voltage devices. Gold is traditionally applied to electrical contacts by electroplating the gold from aqueous solutions of gold complexes, usually cyanides or chlorides. The electronics industry in response to escalating gold prices and ever increasing economic pressures has developed sophisticated equipment for continuous and selective plating of gold in spots and stripes on strips of metal components. There are, however, a number of problems associated with electroplating gold, such as contamination of the baths accompanied by the codeposition of undesirable materials on the contacts; restriction of the range of current usable to obtain optimum plating thus limiting the speed at which components may be plated; waste due to excessive coverage; and hazards associated with the use of such poisonous compounds as potassium cyanide. Concomitant with these are the associated problems of the disposal of the hazardous industrial waste.

Mechanic Ball Attachment (MBA) is a technology different what disclosed on U.S. Pat. No. 6,024,584 issued to Lekme on Feb. 15, 2000 along with its patent family discloses how to resist solder wicking along the contact by means of nickel layer or other mechanical measurements or even chemicals. In the MBA-type socket connector, the solder ball is merely held by a mechanic force between the solder tail and housing. It is simple, and easy to make. Nevertheless, the down side is since the flux deployed onto the substrate has a limited capability to travel over the solder ball, and finally reaches to the area between the solder ball and the solder tail. Accordingly, cold joint, or poor soldering are frequently happened and encountered by the MBA socket connector. However, few attempts have been given, less to say successful result can be reached.

Ironically, it is believed that China Utility Model Patent No. CN2842814Y issued to Chen (Chen '814 patent) on Nov. 29, 2005 discloses a potential technology to resolve the above described issue by applying solder paste between solder balls and corresponding solder tails, see FIGS. 2, 3, 4, and 5. However, Chen does not detailedly and thoroughly disclose how those solder paste is applied between the solder ball and the cavity of the housing. In the above described Chen '814 patent, a lower portion of the contact terminal is almost completely located within the passageway, i.e. the passageway is completely blocked by the solder ball, rending it is difficulty or even impossible and inconvenient to apply the solder paste onto the lower portion located inside of the passageway. Practically assuming, it is impossible to apply the solder paste after the solder ball is attached. In addition, the solder paste is sticky, and if additional or excessive solder paste leaks out from the lower portion, their sticky property may create lots of mess during handling and delivery. If the solder paste extends or wicks way up into a middle portion of the contact terminal, then it would be very much likely that the geometry of the contact terminal will be altered and negate proper and intended function of the contact terminals.

It is desirable to provide an improved socket connector with a fusible element immovably connected to a soldering portion of a contact terminal and further with dried oxidation retarding and solder affinity matter deployed on the fusible element, and/or on the soldering portion, and/or between the fusible element and the soldering portion so as to achieve robust welding quality.

SUMMARY OF THE INVENTION

The present invention provides an electrical connector having a fusible element for mounting on a substrate. The electrical connector includes an insulative housing, a contact terminal retained in the insulative housing and an oxidation retarding and solder affinity matter. The insulative housing defines a mating face and a passageway extending through the mating face. The contact terminal includes a resilient contacting arm extending beyond the mating face and a soldering portion for mating with the fusible element. The oxidation retarding and solder affinity matter is selectively deployed on the fusible element, and/or on the soldering portion, and/or between the fusible element and the soldering portion, or all required area perfecting the solder joint. The oxidation retarding and solder affinity matter is dried to immovably lock down the fusible element.

The present invention also provides a method for trimming an electrical connector to have robust welding properties. The method includes the steps of:

S1) providing the electrical connector comprising an insulative housing, a contact terminal retained in the insulative housing and a fusible element attached to a soldering portion of the contact terminal, the fusible element being movable under this step;

S2) deploying an oxidation retarding and solder affinity matter onto the fusible element and/or onto the soldering portion and/or between the fusible element and the soldering portion; and S3) drying the oxidation retarding and solder affinity matter so as to immovably lock down the fusible element.

When the above electrical connector is soldered to the substrate through a reflowing process, the fusible element is melted under a high temperature and the dried oxidation retarding and solder affinity matter will be active to clean and remove an oxidized layer originally existed on the soldering portion so as to achieve robust welding quality.

DETAILED DESCRIPTION OF PREFERRED EMBODIMENT

Figure 1:
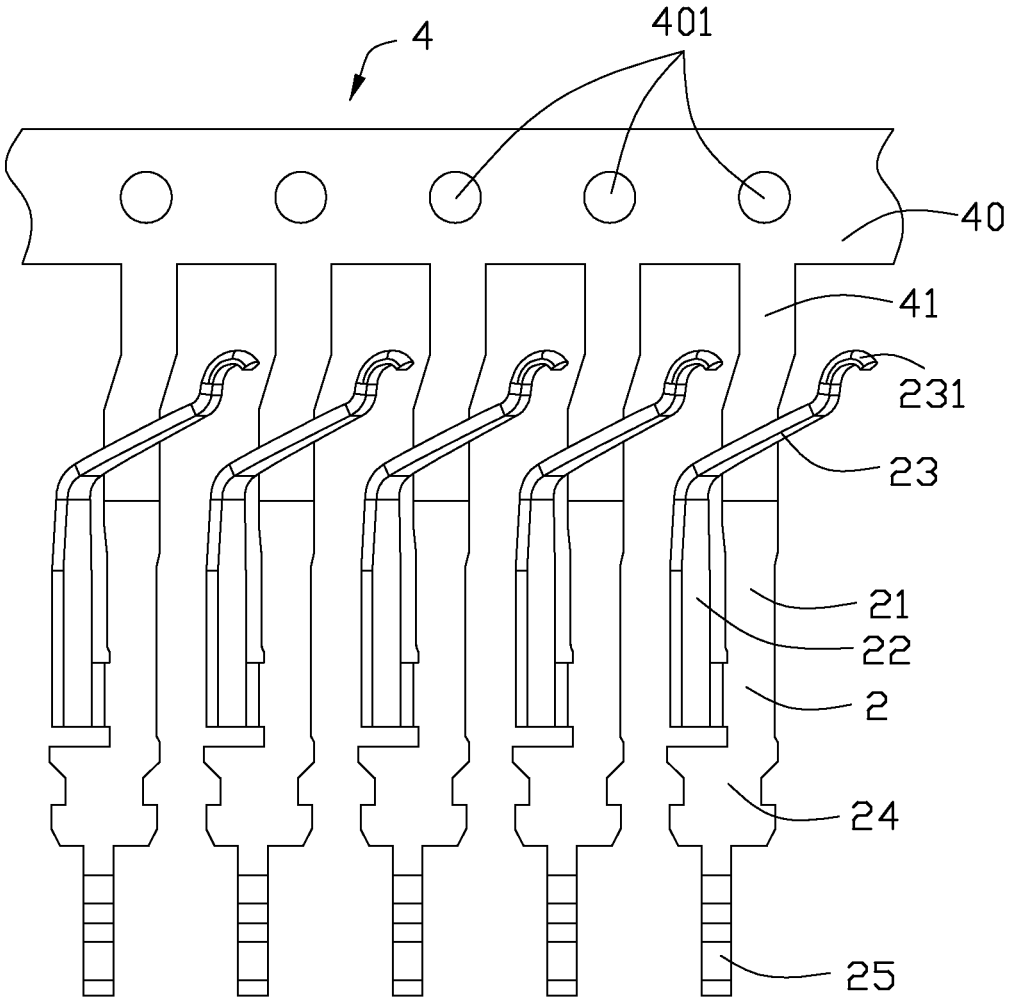
FIG. 1 is a side elevational view of a carrier strip stamped with a plurality of contact terminals in accordance with an illustrated embodiment of the present invention.
Figure 2:
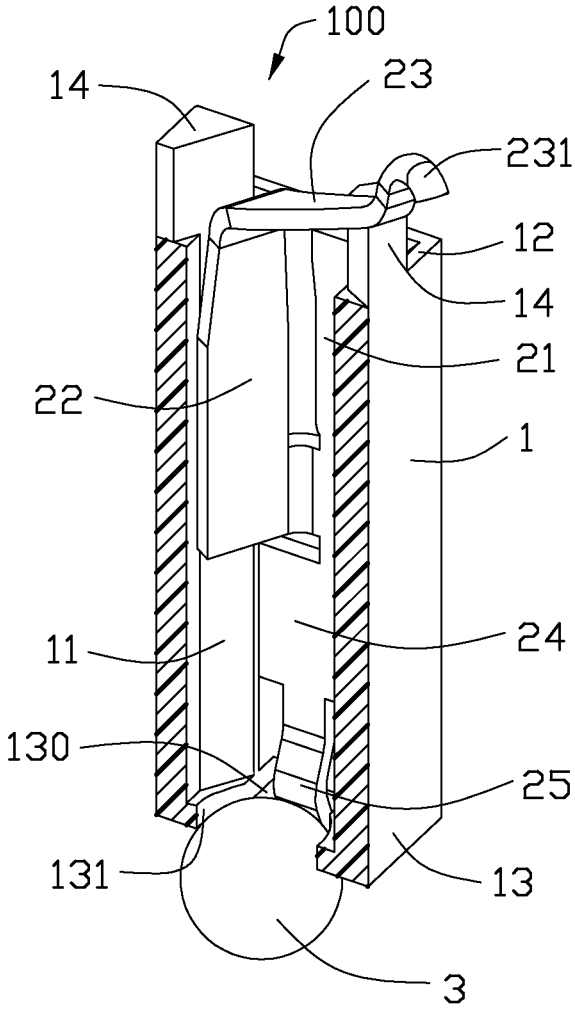
FIG. 2 is an illustractional view of a socket connector showing one of the contact terminals, removed from the carrier strip of FIG. 1, is disposed in a passageway of the socket connector, and a solder ball cradled by the contact terminal.
Figure 3:
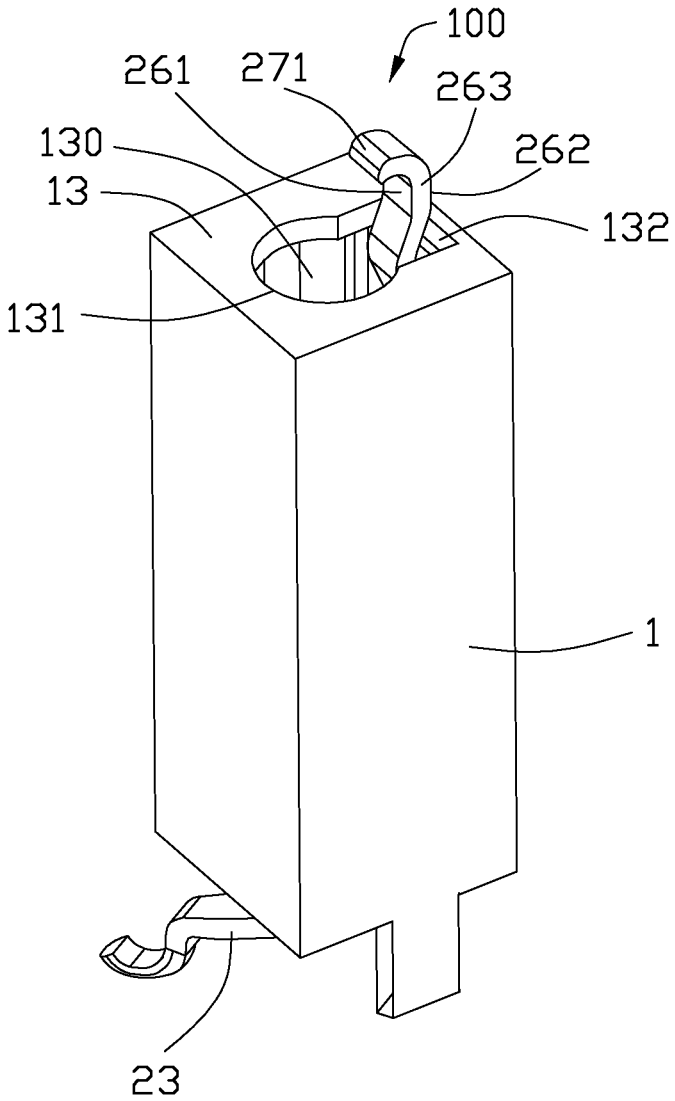
FIG. 3 is another illustractional view of the socket connector as shown in FIG. 2 without the solder ball, while taken from another aspect.

Referring to FIGS. 1 to 3, according to an illustrated embodiment of present invention, a carrier strip 4 stamped from a conductive metal sheet is disclosed. The carrier strip 4 includes a strip 40 defining a plurality of positioning holes 401, a plurality of contact terminals 2 stamped from the metal sheet, and a plurality of interconnections 41 connecting the contact terminals 2 and the strip 40. Each contact terminal 2 includes a base portion 21, an extension portion 22 sidewardly extending from the base portion 21, a resilient contacting arm 23 upwardly and obliguely extending from a top side of the extension portion 22, a retaining portion 24 downwardly extending from the base portion 21, and a soldering portion 25 further downwardly extending from the retaining portion 24 for engaging with a fusible element, such as a solder ball 3. The base portion 21 is substantially located in a first vertical plane. The extension portion 22 is located in a second vertical plane having an angle larger than 90 degrees with respect to the first vertical plane. The resilient contacting arm 23 extends towards the base portion 21 and includes a raised contacting portion 231 further extending beyond the base portion 21 for electrically contacting with a conductive pad of an IC package (not shown). The extension portion 22 is wider than the resilient contacting arm 23 so that the extension portion 22 can be arranged to well support the resilient contacting arm 23 and the resilient contacting arm 23 can be provided with robust flexibility.

Figure 10:
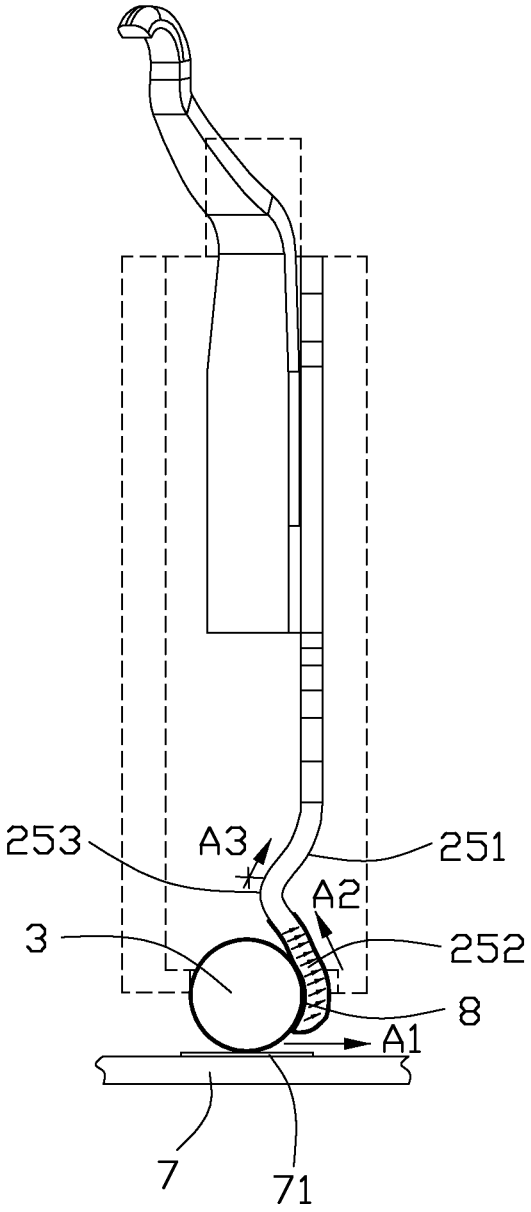
FIG. 10 is an illustractional view of the socket connector mounted on a conductive pad of a substrate before a reflowing process.

FIGS. 2, 3 and 10 illustrate a socket connector 100 which is adapted to be mounted on a substrate 7 with a plurality of conductive pads 71 (only one of them is shown for simplicity). The socket connector 100 includes an insulative housing 1 defining a top surface 12 beyond which the resilient contacting arms 23 extend, a bottom wall 13 facing the substrate 7, and an array of passageways 11 (only one of them is shown for simplicity) extending through the top surface 12 and the bottom wall 13 for receiving the contact terminals 2. As shown in FIG. 3, the bottom wall 13 further defines a plurality of ball-receiving holes 130 (only one of them is shown for simplicity) in communication with the corresponding passageways 11. The bottom wall 13 includes a first engaging edge 131 exposed to the ball-receiving hole 130 for abutting against the solder ball 3 and a second engaging edge 132 exposed to the ball-receiving hole 130 for resisting against the tortuous portion 25 when the solder ball 3 is inserted. The contact terminals 2 are assembled in the corresponding passageways 11 along a top-to-bottom direction. The insulative housing 1 further includes a pair of projecting standoffs 14 formed on the top surface 12 and associated with each of the passageways 11. The provision of the standoffs 14 will prevent the resilient contacting arms 23 from collapsing in case excessive work load is inadvertently exerted and deployed to the resilient contacting arms 23.

Figure 4:
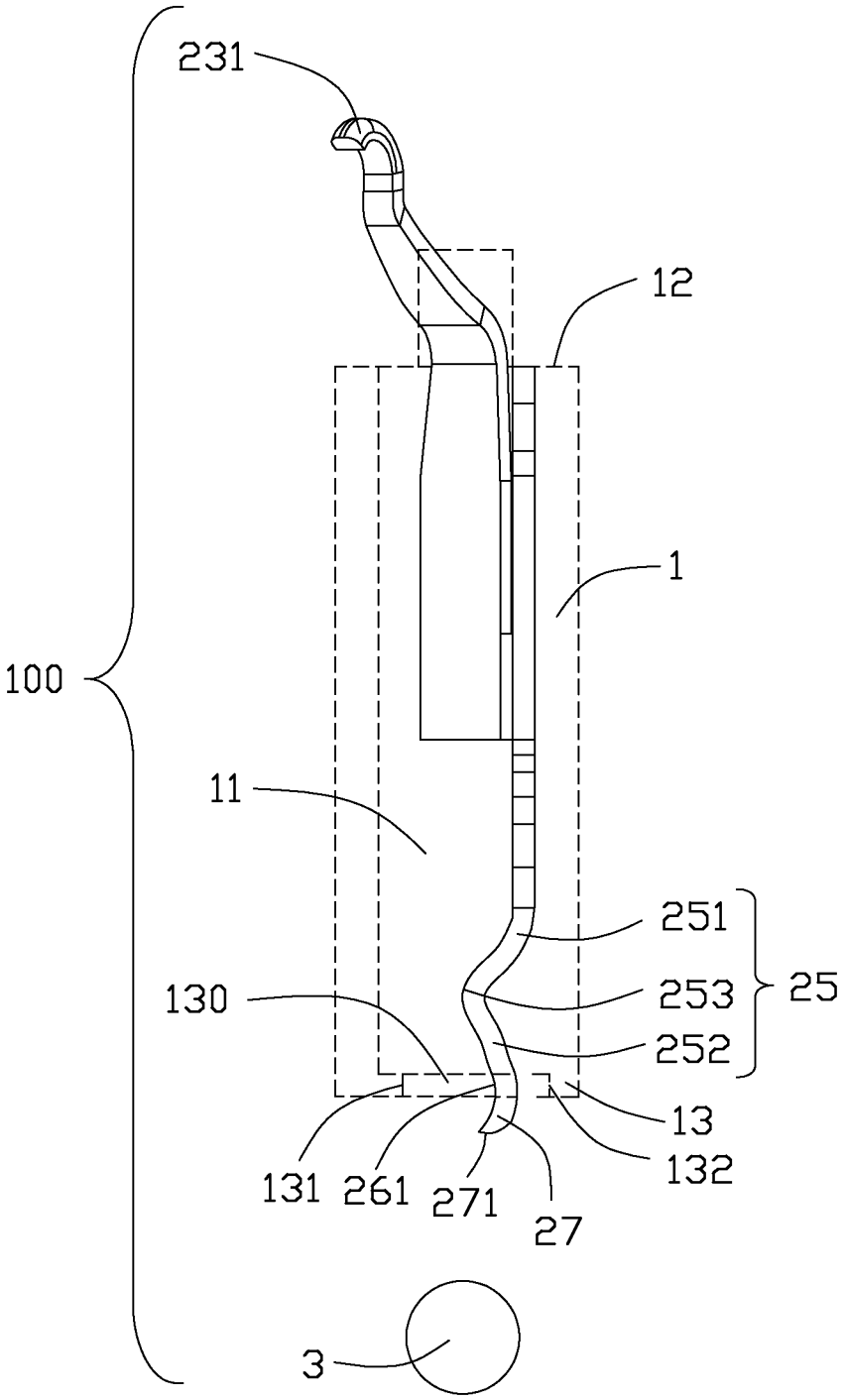
FIG. 4 is another illustractional view of the socket connector similar to FIG. 2 before the solder ball is inserted therein, while taken from another aspect.
Figure 5:
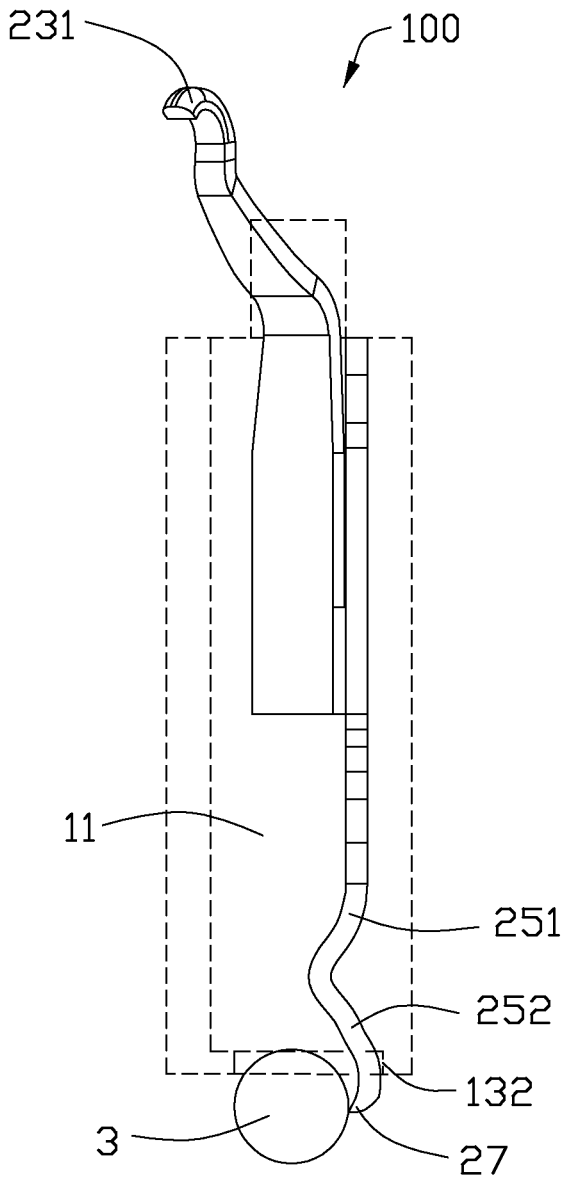
FIG. 5 is an illustractional view of the socket connector as shown in FIG. 4 with the solder ball partly inserted therein.
Figure 6:
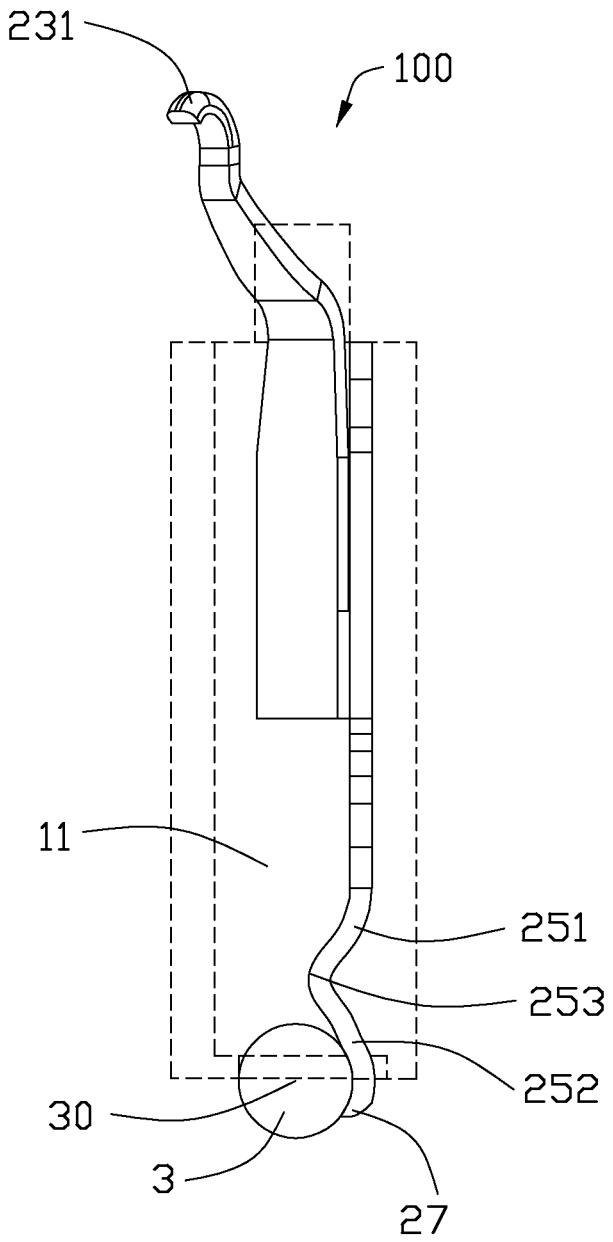
FIG. 6 is an illustractional view of the socket connector as shown in FIG. 5 with the solder ball wholly inserted therein.

Now referring to FIGS. 4 to 6, the tortuous portion 25 includes a first bent section 251 located inside the corresponding passageway 11, a second bent section 252 extending from the first bent section 251 and a peak 253 connecting the first and the second bent sections 251, 252. The first bent section 251 is bent towards a central line of the corresponding passageway 11 along a first direction. The peak 253 resides in the corresponding passageway 11 and functions as a stopper for preventing the solder ball 3 from being over-inserted thereinto along a bottom-to-top direction. The second bent section 252 is bent to cradle the solder ball 3 along a second direction as shown in FIG. 6. According to the illustrated embodiment of the present invention, the second bent section 252 defines an inner surface 261, an outer surface 262 opposite to the inner surface 261 and a pair of side surfaces 263. The inner surface 261 is curved and configured to attach and meet the ball surface of the solder ball 3 so as to not only provide greater surface contact for stably gripping the solder ball 3 but also provide greater surface for robust welding assurance, i.e. attracting and attaching solder thereto so as to prevent cold joint. The second bent section 252 extends downwardly beyond the bottom wall 13 of the insulative housing 1 and functions as a solder tail for combining with the solder ball 3 by welding. The second bent section 252 further includes a curved guiding surface 271 at a distal end 27 thereof for guiding insertion of the solder ball 3. As shown in FIG. 6, the distal end 27 is positioned lower than a center 30 of the solder ball 3 along a vertical direction so that the distal end 27 is capable of providing an upward force for holding the solder ball 3.

The tortuous portion 25 of the contact terminal 2 extends substantially beyond the bottom wall 13 of the insulative housing 1. As shown in FIG. 3, in this embodiment, the first engaging edge 131 is curved. When the solder balls 3 are mechanically inserted into the ball-receiving holes 130 along the bottom-to-top direction, under the guidance of the guiding surface 271, the second bent section 252 is engaged by the solder ball 3 to outwardly deform. Since the second bent section 252 is restricted by the second engaging edge 132, the second bent section 252 can be prevented from over-deformation. Once the solder ball 3 overcomes the corresponding guiding surface 271, the second bent section 252 releases part of its elasticity, as a result, the solder ball 3 can be snuggly secured between the first engaging edge 131 and the second bent section 252. Besides, under the help of the peak 253, the solder ball 3 can be prevented from being over-inserted in to the corresponding passageway 11 along the bottom-to-top direction, i.e. the solder ball 3 can be correctly seated to a predetermined position. Ultimately, the first engaging edge 131 provides horizontal support or positioning to the solder ball 3, and the second bent section 252 provides vertical support or positioning to hold the solder ball 3 in position.

Figure 8:
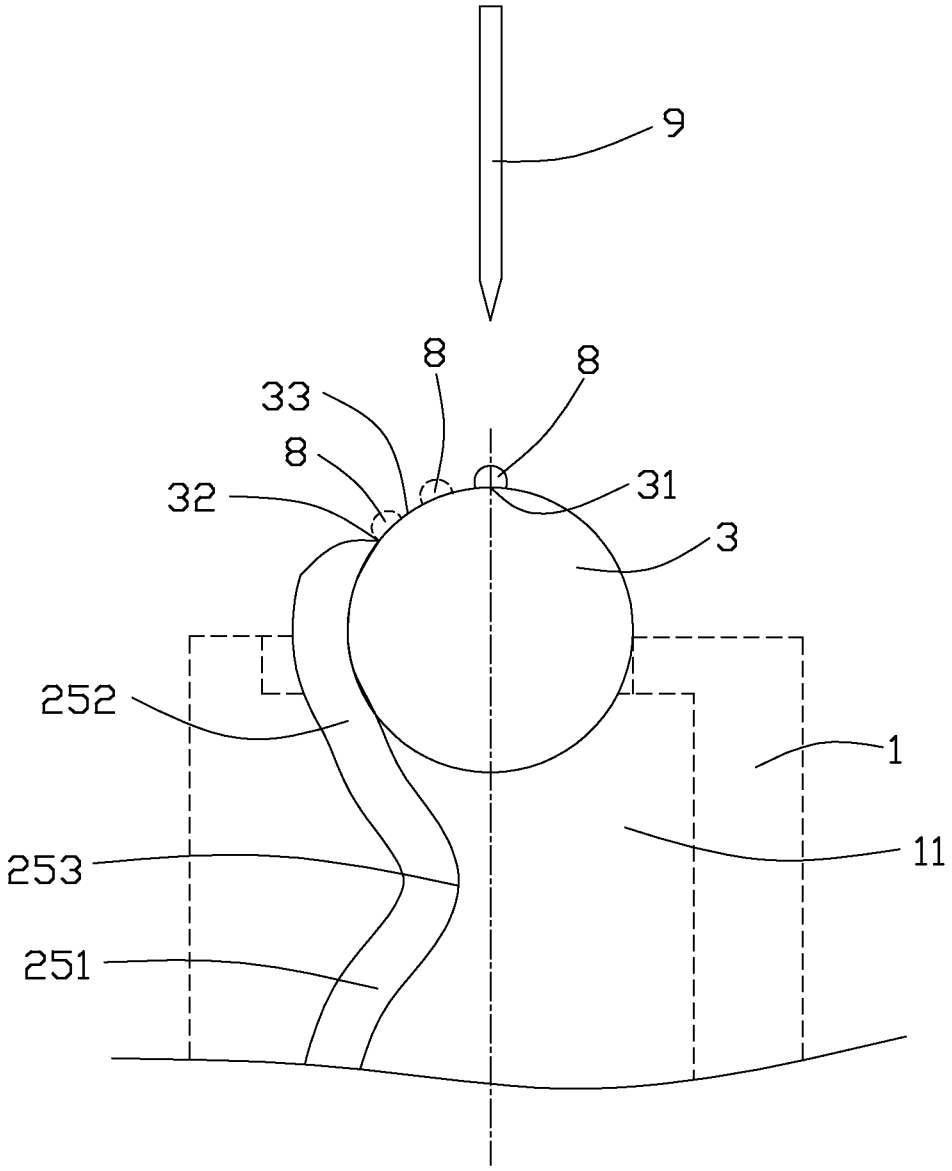
FIG. 8 is partly enlarged view of the socket connector of FIG. 7 with a gelatinous flux dropped on a pertinent area of the solder ball through a dosing apparatus.
Figure 9:
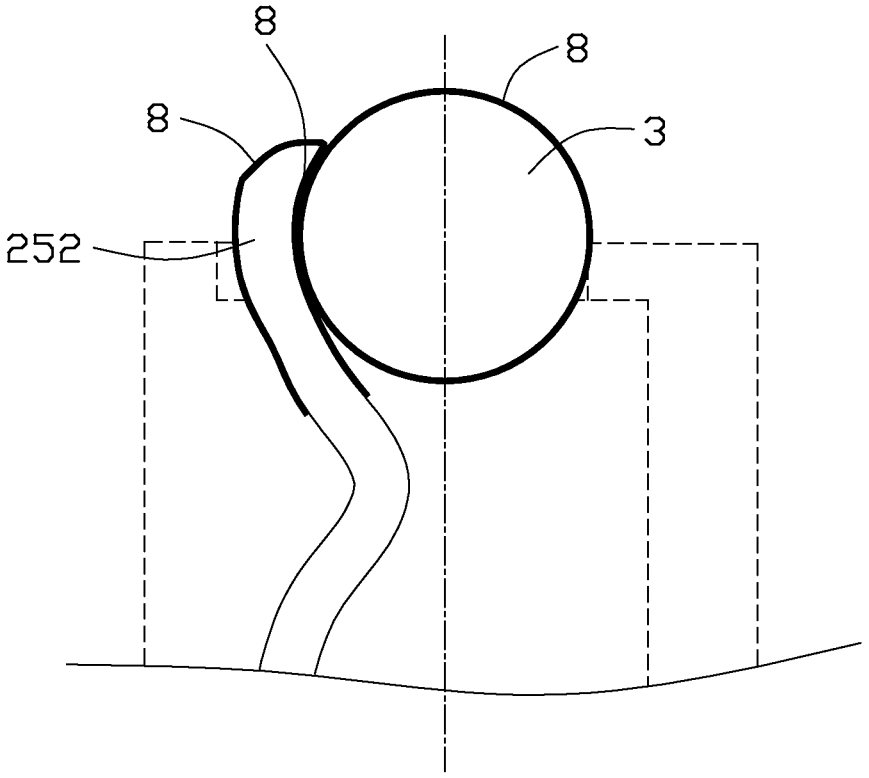
FIG. 9 is another partly enlarged view of the socket connector as shown in FIG. 8 with the gelatinous flux being heated to deploy on the solder ball and the contact terminal.

It is understandable that after the solder balls 3 are assembled to the socket connector 100, the solder balls 3 are still capable of rotating once friction force for gripping the solder balls 3 is defined over by peripheral forces, e.g. generating by hand. Under this condition, since the solder balls 3 are not immovable, potential risk of the solder balls 3 falling off from the socket connector 100 may still be a major concern. In order to make the solder balls 3 securely fixed in the socket connector 100 to avoid such potential risk of falling off, an oxidation retarding and solder affinity matter is deployed on the solder balls 3 and the second bent sections 252 of the terminal contacts 2. As shown in FIGS. 8 to 10, the oxidation retarding and solder affinity matter is preferably a flux 8 containing most part of isopropanol along with other ingredients. The flux 8 is original gelatinous.

In detail, during dosing or seeding of the flux, the gelatinous flux 8 is initially deployed on each solder ball 3, and then a heating process is adopted to heat the gelatinous flux 8. Such heating process includes two sub-processes, in the first sub-process, the gelatinous flux 8 becomes liquefied so as to coat the solder balls 3 and the second bent sections 252, and permeate into an area located between the solder balls 3 and the second bent sections 252 under capillary phenomenon, in the second sub-process, the liquid flux 8 is further dried so as to immovably lock down the solder balls 3 and the second bent sections 252. In addition, in the first sub-process, except the inner surface 261, the flux 8 is also deployed on the outer surface 262 and the pair of side surfaces 263. In such heating process, the temperature is carefully controlled to be lower than the melting point of the solder balls 3. It is noticed that the volume of the gelatinous flux 8 is for schematic only and does not represent the true dosage in actual usage.

Figure 7:
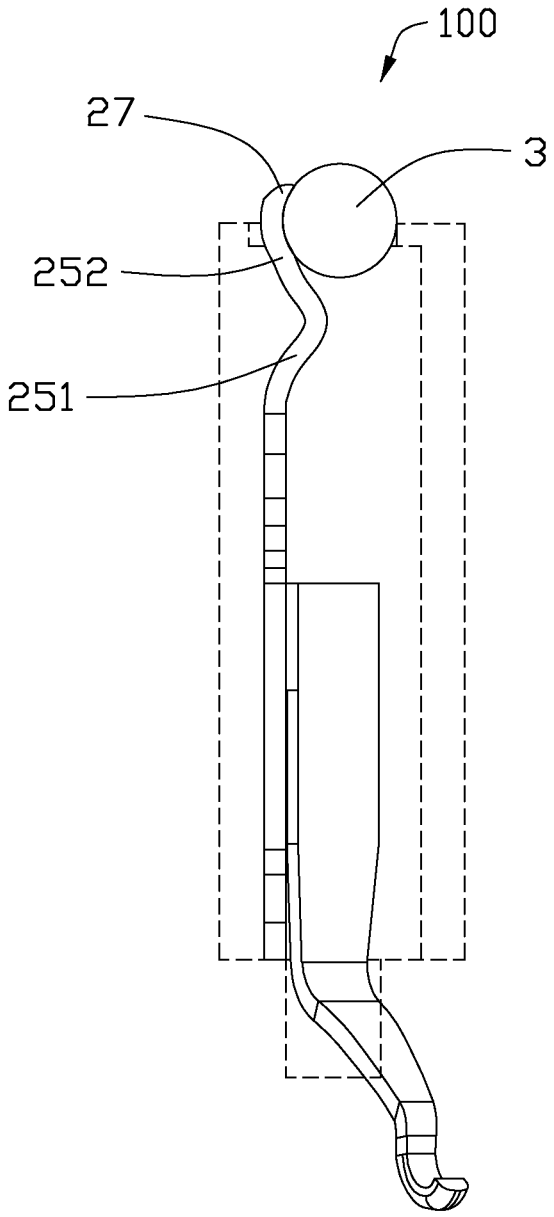
FIG. 7 is another illustractional view of the socket connector, but having rotated 180 degrees with respect to the socket connector shown in FIG. 6.

As shown in FIGS. 7 and 8, according to the preferred embodiment of the present invention, before the heating process, the socket connector 100 is flipped over to make the solder ball 3 at the top thereof, and the gelatinous flux 8 is dropped through a dosing apparatus 9 at the topmost portion 31 of the solder ball 3, or positioned at a top joint 32 of the solder ball 3 and the second bent section 252, or positioned at a pertinent area 33 along the peripheral ball surface between the top joint 32 and the topmost portion 31 of the solder ball 3. In the heating process, the flux 8 becomes liquefied and then flows downwardly under the gravitation to deploy on the solder ball 3 and the second bent section 252, as shown in FIG. 9.

However, it is understandable that, in other embodiments, the flux 8 can be in the form of liquid and then sprayed or brushed onto the solder balls 3 and the second bent sections 252, and the flux 8 is dried by a subsequent heating process to immovably fix the solder balls 3 and the second bent sections 252.

Figure 11:
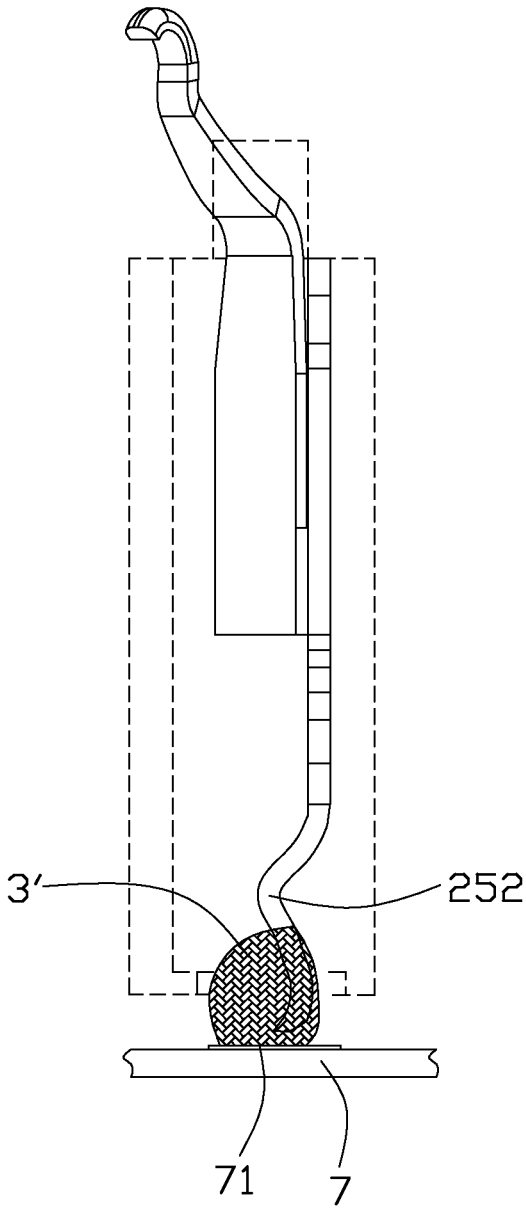
FIG. 11 is an illustractional view of the socket connector mounted on the conductive pad of the substrate after the reflowing process.

When the solder balls 3 of the socket connector 100 are melted and soldered to the conductive pads 71 of the substrate 7 through a reflowing process, the flux 8 can effectively and thoroughly clean and remove an oxidized layer on the tortuous portion 25 during the reflowing process. Bearing in mind that the second bent section 252 is completely covered with the pre-coated flux 8, it is very similar to being covered with a flux sock, as shown in FIG. 9. That is to say, the inner surface 261, the outer surface 262 and the pair of side surfaces 263 of the second bent section 252 are all covered with the pre-coated flux 8. As a result, when the solder ball 3 is heated to a molten temperature, firstly, from a viewpoint of fluid dynamics, the second bent section 252 will incise into the molten solder ball 3 resulted from a relief of its pre-stress as the second bent section 252 is pushed backward by the solder ball 3. Secondly, since the second bent section 252 is coated with the solder affinity flux 8, accordingly, the melted solder mass from the solder ball 3 will be naturally pulled or attracted toward the second bent section 252 by the pre-coated flux 8, i.e. the melted solder mass on the left side of the second bent section 252 as shown in FIG. 11, will be naturally pulled and attracted to the right side of the second bent section 252 because of the capillary force, see those small arrows and an arrow A1 as shown in FIG. 10. With the effective shift and transfer of the solder mass of the solder ball 3 from the left toward the right, the solder mass which was originally built-up or located to the first engaging edge 131 of the bottom wall 13, is tremendously reduced in a way that once the molten solder ball 3 is solidified, the solder ball 3 will be transformed into a tear-drop shaped solder element 3' with minimum contact with the first engaging edge 131 of the bottom wall 13, such as best illustrated in FIG. 11. Accordingly, with the provision of the pre-coated flux 8 over the second bent section 252, the second bent section 252 is almost completely embraced by the solder element 3'. Not only will this create an excellent and robust solder joint between the substrate 7 and the second bent section 252, the Coefficient of Thermal Expansion (CTE) is also impressively reduced as the solder element 3' is not trapped anymore by the bottom wall 13 of the insulative housing 1.

During the reflowing process, the dried flux 8 will be rejuvenile to clean and remove the oxidized layer originally existed on the tortuous portion 25, then the molten solder mass of the solder balls 3 can be evenly and homogeneously distributed along the tortuous portion 25 effectively to prevent the molten solder balls 3 from inadvertently or unwantedly staying still adjacent to the conductive pads 71 of the substrate 7. Beside, on one side, the flux 8 will help the molten solder mass travelling upwardly along an arrow A2 so as to achieve robust solder joint as shown in FIG. 11, while on the other side, because the first and the second bent sections 251, 252 have an angle larger than 90 degrees or any other and effective angles, the molten solder mass of the solder balls 3 can be prevented from over-travelling upwardly beyond the peak 253 along an arrow A3 so as to restrain the siphon phenomenon of the molten solder mass. This peak 253 servers as a thermal break as well demonstrated by the Lemke '389 patent, which is impractical to implement in light of this tiny solder tail. Moreover, the flux 8 can prevent the molten solder mass of the solder balls 3 from being oxidized under the high temperature during the reflowing process. Most importantly, even if the socket connector 100 and/or the substrate 7 suffer from deformation and separate the solder balls 3 and the conductive pads 71 along a vertical direction under the high temperature during the reflowing process, and without the help of the flux of the solder paste, it will usually be formed on the conductive pads 71, however, in the present invention excellent welding quality can still be assured by the flux 8 as it has already existed on the solder balls 3 and/or the second bent sections 252 and/or between the solder balls 3 and the second bent sections 252.

Since the quantity and area in which the flux 8 is deployed is accurately calibrated and controlled to reach a nominal position or height, accordingly, the solder mass of the molten solder ball 3 can travel, or move to those pre-selected and calibrated area, i.e. at least the second bent section 252. With the provision and disclosure of the present invention, the prior art problems can be successfully resolved.

Figure 14:
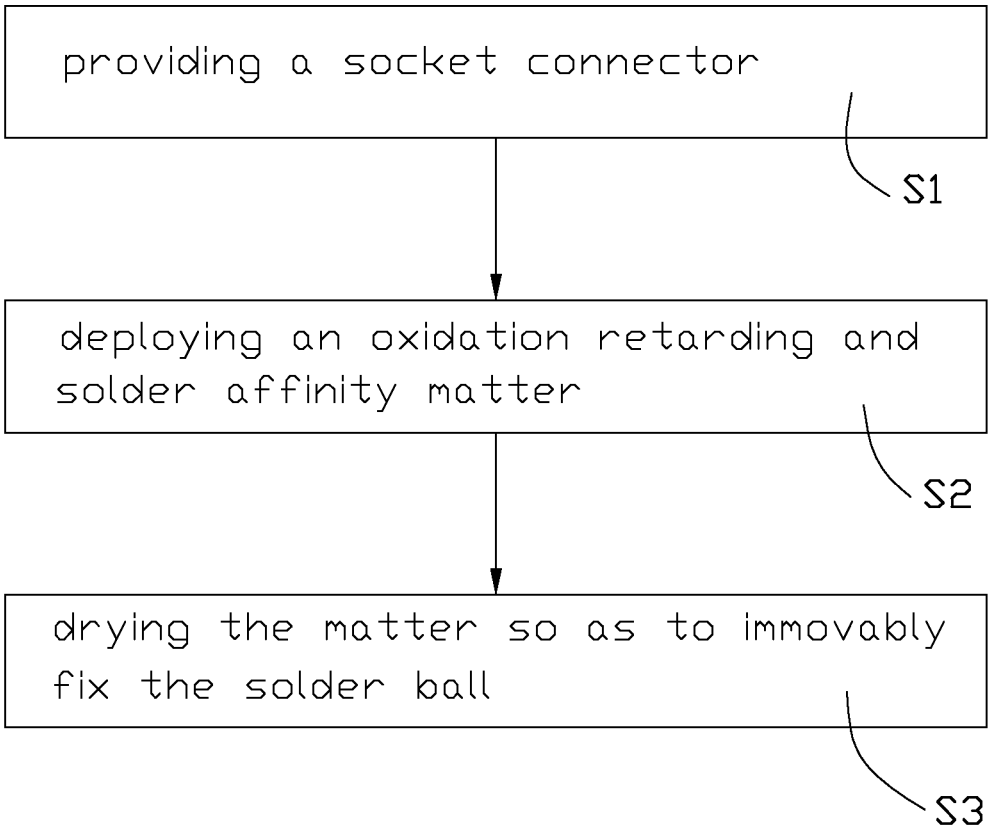
FIG. 14 is a flow diagram illustrating how a layer of preparation of oxidation-retarding and solder affinity material is deployed onto a solder portion of the contact terminal discussed above.

FIG. 14 shows a method for trimming a socket connector 100 to have robust welding properties. The method including the following steps:

S1): providing a socket connector 100 having an insulative housing 1, a plurality of contact terminals 2 retained in the insulative housing 1 and a plurality of solder balls 3 attached to soldering portions 25 of the contact terminals 2;

S2): deploying an oxidation retarding and solder affinity matter, such as a flux 8, onto the solder balls 3 and/or onto the soldering portions 25 and/or between the solder balls 3 and the soldering portions 25; and S3): drying the flux 8 so as to immovably fix the solder balls 3.

Preferably, the step S2 includes following sub-steps of:

S21): deploying the gelatinous flux 8 onto a topmost portion 31 of each solder ball 3, and/or onto a top joint 32 of each solder ball 3 and the soldering portion 25, and/or onto a pertinent area 33 of along a peripheral ball surface between the top joint 32 and the topmost portion 31 of the solder ball 3; and S22): heating the gelatinous flux 8 to become liquefied so as to flow downwardly under the gravitation and to be coated on the solder balls 3 and/or on the soldering portions 25 and/or between the solder balls 3 and the soldering portions 25. Alternatively, in the step S2, the flux 8 is original in the form of liquid and is sprayed or brushed onto the solder balls 3 and/or onto the soldering portions 25 and/or between the solder balls 3 and the soldering portions 25.

Preferably, another step of flipping over the socket connector 100 to make the solder balls 3 at the top thereof is applied, between the step S1 and the step S2. In the step S3, the flux 8 is dried under a temperature which is lower than the melting point of the solder balls 3. The oxidation retarding and solder affinity matter contains following materials with content in weight: isopropanol (>90%), resin (<5%), surfactant (<5%), anti-corrosive (<5%) and dispersant (<1%). Wherein, the resin can be chosen from following groups: gum rosin, wood rosin, ester of hydrogenated rosin, dehydrogenated rosin, and polymerized rosin. The surfactant can be chosen from following groups: perfluoroalkyl ethoxylate, cetyltrimethylammonium bromide and nonylphenoxypolyethoxyethanol. The anti-corrosive can be chosen from following groups: BHT (2,6-Di-tert-butyl-4-methylphenol purum), triphenyl phosphate, double-hydroquinone, 1,2,3-hydroxybenzotriazole, 2-Ethylhexyl glycidyl ether, tetrahydrofurfuryl alcohol and Palmitate. The dispersant can be chosen from following groups: nitroethane, dipropylene glycol methyl ether, diethylene glycol monobutyl ether and polyglycol.

Figure 12:
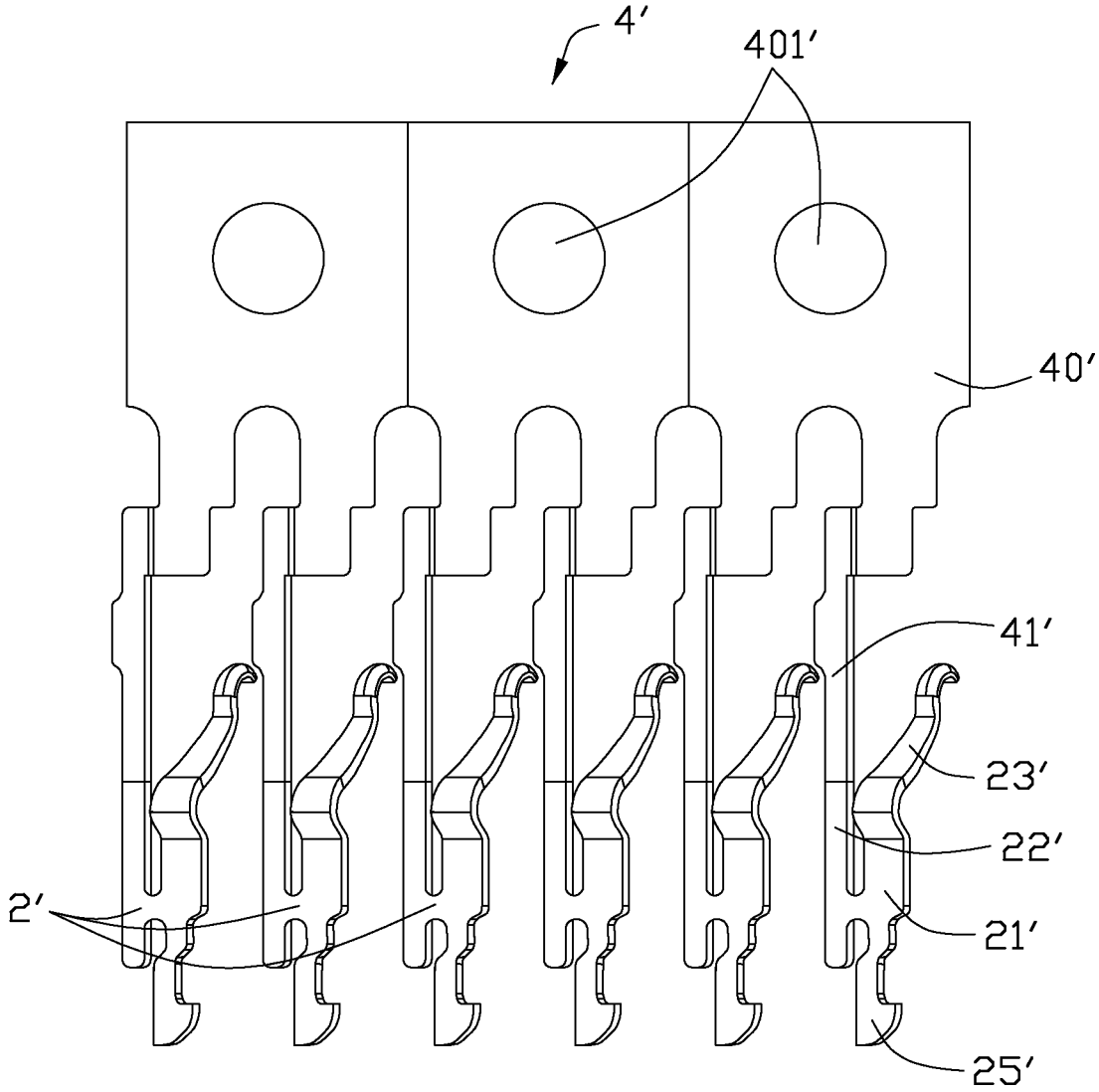
FIG. 12 shows another carrier strip stamped with a plurality of another contact terminals made in accordance with another embodiment of the present invention.
Figure 13:
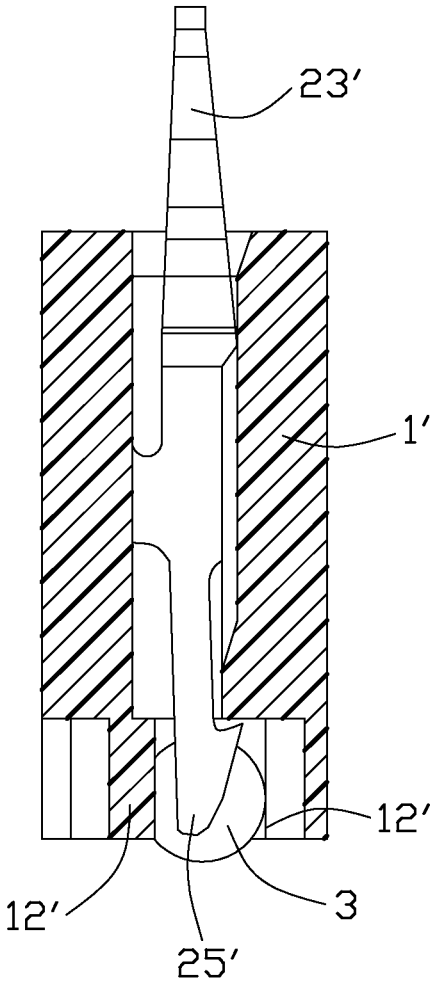
FIG. 13 is an illustractional view of another socket connector showing one of the another contact terminals, removed from the another carrier strip of FIG. 12, is disposed in a passageway of an insulative housing, and a solder ball gripped by the another contact terminal and the insulative housing.

Referring to FIGS. 12 and 13, according to another embodiment of present invention, another type of contact terminal 2' formed on a contact strip 4' is disclosed. The carrier strip 4' includes a strip 40' defining a plurality of positioning holes 401', a plurality of contact terminals 2' stamped from a metal sheet, and a plurality of interconnections 41' connecting the contact terminals 2' and the strip 40'. Each contact terminal 2' includes a base portion 21', an extension portion 22' sidewardly extending from the base portion 21', a resilient contacting arm 23' upwardly and obliguely extending from a top side of the extension portion 22', and a mounting portion 25' downwardly extending from the base portion 21'. As shown in FIG. 13, each contact terminal 2' is assembled to an insulative housing 1', which has a plurality of protrusions 12' on an exterior bottom side thereof. The protrusions 12' and the mounting portion 25' cooperatively clamp the solder ball 3 to retain the solder ball 3 in position.

Similar with the contact terminal 2 in the first embodiment, an oxidation retarding and solder affinity matter, such as the flux 8, is deployed on the mounting portion 25' and/or the solder ball 3 after the contact terminal 2' is assembled to the insulative housing 1' and is gripped by the protrusions 12' and the mounting portion 25'. The oxidation retarding and solder affinity matter is spayed to the pertinent area of the mounting portion 25' and/or the solder ball 3, and after it is dried, the solder ball 3 is immovably fixed to the mounting portion 25'. So, when the solder ball 3 is melted, the dried oxidation retarding and solder affinity matter cleans an oxidized layer on the mounting portion 25', then the molten solder 3 can be evenly and homogeneously distributed along the tortuous portion 25' effectively to prevent the molten solder ball 3 from flowing toward the conductive pad 71 of the substrate 7.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector having a solder ball for mounting on a substrate, comprising:

an insulative housing defining a mating face and a passageway extending through the mating face;

a contact terminal residing in the passageway and comprising a resilient contacting arm extending beyond the mating face and a soldering portion which is curved to comply with the solder ball and outwardly deformable to allow the solder ball to be inserted between the soldering portion and the insulative housing along a bottom-to-top direction; and a flux deployed on both the soldering portion and the solder ball after the solder ball is positioned by the soldering portion and the insulative housing; wherein the flux is dried to immovably fix the solder ball to the soldering portion of the contact terminal.

2. The electrical connector as claimed in claim 1, wherein the flux is initially in gelation form which is then heated to become liquefied so as to coat a pertinent area of the soldering portion and the solder ball, and the liquid flux is dried under a temperature which is lower than a melting point of the solder ball.

3. The electrical connector as claimed in claim 1, wherein the flux is initially in liquid form and is then sprayed or brushed onto a pertinent area of the soldering portion and/or the solder ball, and the liquid flux is dried under a temperature which is lower than a melting point of the solder ball.

4. The electrical connector as claimed in claim 1, wherein when the solder ball is soldered to the substrate through a reflowing process, the dried flux will be re-juvenile to clean and remove an oxidized layer originally already existed on the soldering portion so that the molten solder ball can be evenly and homogeneously distributed along the soldering portion effectively to prevent the molten solder ball from inadvertently flowing toward the substrate even if without any flux from the substrate.

5. The electrical connector as claimed in claim 1, wherein the soldering portion comprises a bent solder tail defining an inner curved surface configured to engage with a peripheral ball surface of the solder ball from a first side, and a bottom wall of the insulative housing defines a ball-receiving hole and a curved first engaging edge exposed to the ball-receiving hole to engage with the peripheral ball surface of the solder ball from a second side opposite to the first side.

6. The electrical connector as claimed in claim 5, wherein the soldering portion comprises a first bent section protruding towards a central line of the passageway and a peak connecting the first bent section and the bent solder tail, the peak being positioned inside the passageway to resist against the solder ball and prevent the solder ball from over-insertion into the ball-receiving hole.

7. The electrical connector as claimed in claim 1, wherein the soldering portion comprises a bent solder tail defining an inner surface to grip the solder ball, an outer surface opposite to the inner surface and a pair of side surfaces, and wherein the flux is deployed on the inner surface, the outer surface and the pair of side surfaces.

8. An electrical connector having a fusible element for mounting on a substrate, comprising:

an insulative housing defining opposite mating face and mounting face, and a passageway extending through both the mating face and the mounting face;

a contact terminal residing in the passageway and comprising a resilient contacting arm extending around the mating face, and a soldering portion around the mounting face for coupling with the fusible element; and an oxidation retarding and solder affinity layer applied around said fusible element and said soldering portion; wherein the fusible element essentially in an original shape, is attached to the corresponding soldering portion in a fixative manner via not only primary forces exerted from resiliency of the soldering portion but also secondary adhesion derived from solidification of said oxidation retarding and solder affinity layer; wherein the soldering portion is curved to comply with a configuration of the fusible element to compliantly hold the fusible element in position;

the oxidation retarding and solder affinity layer is applied on both the fusible element and the soldering portion after the fusible element is inserted into the passageway and held by the soldering portion.

9. The electrical connector as claimed in claim 8, wherein said oxidation retarding and solder affinity layer is derived from dosing gelatinous flux.

10. The electrical connector as claimed in claim 9, wherein the fusible element is a solder ball, and a flux drop via dosing is initially hit on a bottom end of the solder ball around a vertical center line thereof so as to flow dispersively.

11. The electrical connector as claimed in claim 8, wherein the soldering portion defines a curved segment and the fusible element defines a spherical contour, said oxidation retarding and solder affinity layer being applied to at least one of the curved element and the spherical contour.

12. The electrical connector as claimed in claim 8, wherein the spherical contour share an essentially same curved boundary with the curved segment via at least sixty degrees.

13. The electrical connector as claimed in claim 8, wherein the oxidation retarding and solder affinity layer is melted only when the fusible element is mounted to the substrate.

* * * * *